US005529513A

United States Patent [19]

Lee

[11] Patent Number: 5,529,513

[45] Date of Patent: Jun. 25, 1996

[54] CABLE CONNECTOR HAVING REMOVABLE CODED RINGS

[75] Inventor: Noel Lee, Daly City, Calif.

[73] Assignee: Monster Cable International, Ltd., Bermuda

[21] Appl. No.: 362,002

[22] Filed: Dec. 22, 1994

[51] Int. Cl.[6] ..... H01R 3/00

[52] U.S. Cl. ..... 439/491

[58] Field of Search ..... 439/488, 489, 439/491, 502, 505

[56] References Cited

U.S. PATENT DOCUMENTS

| | | | |
|---|---|---|---|
| 2,892,991 | 6/1959 | Beebee et al. | 439/489 X |
| 4,202,351 | 5/1980 | Biche | 439/491 X |
| 4,227,762 | 10/1980 | Scheiner | 439/491 X |
| 5,334,044 | 8/1994 | Falossi et al. | 439/491 |

FOREIGN PATENT DOCUMENTS

| | | |
|---|---|---|
| 0109365 | 5/1984 | European Pat. Off. . |
| 0609630 | 8/1947 | United Kingdom . |

*Primary Examiner*—Khiem Nguyen

*Attorney, Agent, or Firm*—Haynes and Boone; Warren B. Kice

[57] ABSTRACT

A cable connector and cable assembly incorporating the connector in which a connector housing receives a cable and a pin is supported by the housing for engaging a jack of an associated electronic component. A plurality of removable rings are provided on the housing and can be coded to enable the particular cable to be identified in an audio/video system.

10 Claims, 1 Drawing Sheet

CABLE CONNECTOR HAVING REMOVABLE CODED RINGS

BACKGROUND OF THE INVENTION

This invention relates to a cable connector and, more particularly, to a cable connector which can be attached to a cable to enable the cable to be connected to an electronic component and which includes a plurality of removable coded rings to identify the cable and the component.

Merging video systems with high quality audio systems is becoming increasingly popular. In these installations, several output, or program, sources are available, such as compact disc players, cassette decks, FM tuners, all of which have two stereo outputs; as well as laser disc players, stereo video cassette recorders (VCRs), and satellite receivers, all of which have a video output and two stereo audio outputs. These outputs are usually connected to an input source such as a stereo receiver, amplifier, preamplifier, processor or decoder (hereinafter referred to as "receiver"), which performs switching and processing functions and which includes a power amplifier, or an output to a power amplifier, for driving loudspeakers. The video output of the receiver is routed to a television monitor, or the like, having a video input.

The audio and video outputs of each of the above-mentioned program sources, as well as the corresponding inputs of the receiver, each receive a coaxial connector, often termed a "RCA" connector, which is standard in the industry. Thus, at least two, and sometimes three, cables each provided with a RCA connector at each end, are connected between the program source and the receiver. Still additional cables are needed when one of the program sources, such as a satellite receiver or laser disc player is connected to the input of a VCR for recording the video and audio signals, and the output of the VCR is connected to the receiver.

It can be appreciated with several program sources connected in the above manner, a multitude of cables are required which, along with speaker wires, AC power cords and antenna cables, result in a maize of cables, wires and cords which renders it difficult, if not impossible, to identify the cables and maintain a neat and organized installation.

SUMMARY OF THE INVENTION

It is therefore an object of the present invention to provide a connector for attachment to a cable which enables the cable, and the component associated with the connector, to be identified.

It is a further object of the present invention to provide a connector of the above type in which a plurality of removable rings are provided on the connector which are coded in a manner to enable the cable and its associated component to be identified.

Towards the fulfillment of these and other objects, the connector of the present invention includes a housing for receiving a cable and a pin supported by the housing for engaging a jack of an associated electronic component. A plurality of removable rings are provided on the housing and are coded to enable the particular cable and its associated component to be identified in an audio/video system.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
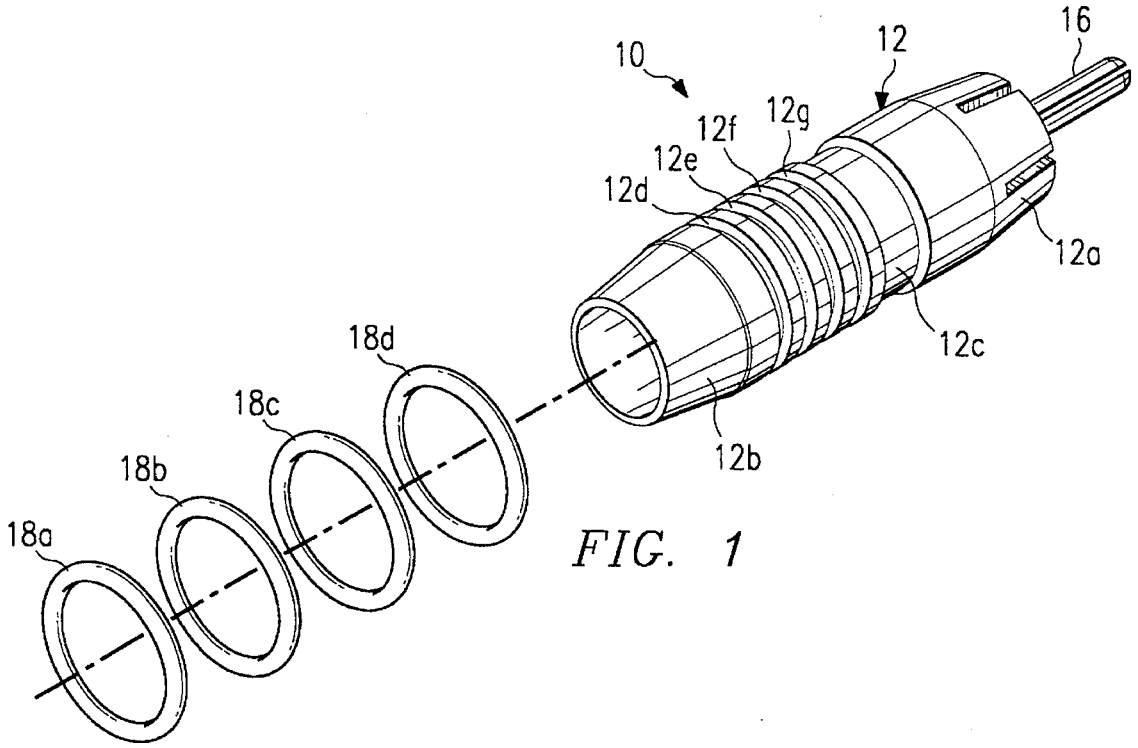
FIG. 1 is an perspective view of the connector of the present invention.
Figure 2:
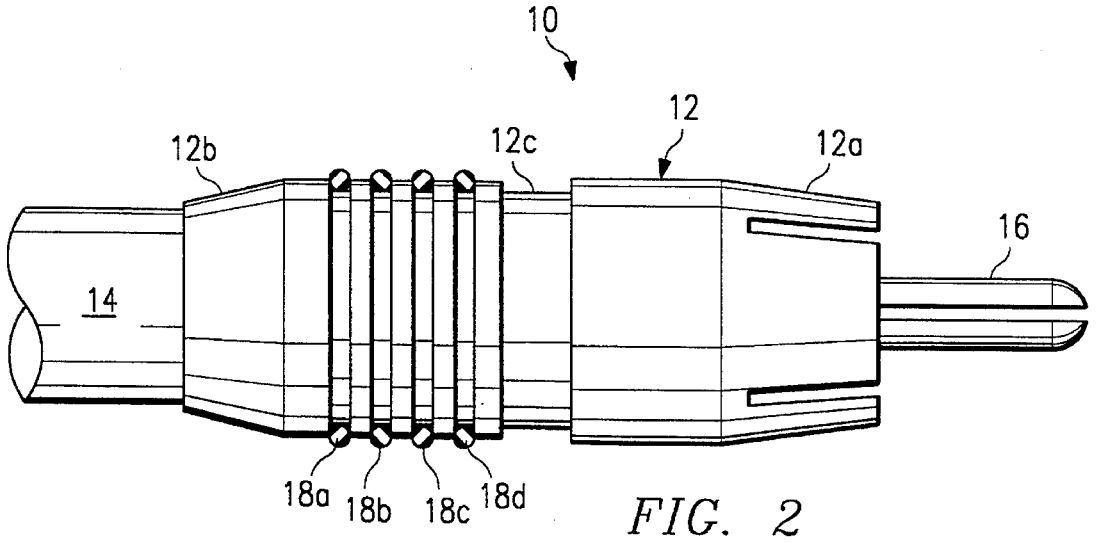
FIG. 2 is an elevational view of the connector of FIG. 1.

Referring to FIG. 1 of the drawings, the reference numeral 10 refers, in general to the connector of the present invention which consists of an elongated tubular housing 12 having a tapered leading end portion 12*a*, a tapered trailing end portion 12*b* and a center portion 12*c* of a slightly reduced diameter. The end portion 12*b* receives a cable 14 (FIG. 2) which includes a center conductor for carrying the positive portion of an audio or video signal, an inner sheath of insulative material surrounding the center conductor, a conductor having an annular cross-section extending around the inner sheath for carrying the negative portion of the signal, and an outer sheath surrounding the latter conductor. Since this type of cable is conventional, it is not shown in detail in the drawings nor will it be described in any further detail.

To connect the cable to the housing 12, the insulation is stripped from an end portion of the cable to expose the above-mentioned conductors, the latter end portion is inserted into the end portion 12*b* of the housing 12 and the conductors are soldered, or otherwise connected to appropriate terminals (not shown) provided on the inner surface of the housing.

A pin 16 projects from the end portion 12*a* of the housing 12 and is supported within the housing in a conventional manner. The pin 16 is adapted to engage a jack provided on an electronic component as will be described.

Referring to FIG. 1, four spaced grooves 12*d*, 12*e*, 12*f* and 12*g* are formed on the outer surface of the housing 12 and are equally spaced between the end portion 12*b* and the reduced-diameter portion 12*c*. Four o-rings 18*a*, 18*b*, 18*c* and 18*d*, each fabricated of an elastic material, are insertable in the grooves 12*d*, 12*e*, 12*f* and 12*g*, respectively. The rings 18*a*, 18*b*, 18*c* and 18*d* are of an elastic or other stretchable material and are sized to enable them to firmly engage the outer surface of the housing 12, yet be quickly removed therefrom.

The o-rings are color-coded to identify the particular cable 14 and, more particularly, the components of an audio/video system to which the cable is to be connected. For example, the color of the ring 18*a* can identify the particular source component such as, for example, a compact disc player, while the color of the ring 18*b* can identify the component, such as a stereo amplifier, to which the disc player is to be connected. The color of the ting 18*c* can identify the particular stereo channel (left or tight), and the color of the ring 18*d* can identify the other stereo channel. Of course, another connector can be attached to the other end of the cable 14 and provided with the removable rings to provide color coding for the other component to which it is attached.

Thus the connector of the present invention permits a connection between two components in an audio system in a manner to enable the components and the particular connections to the components to be easily identified. Of course, each connector can be supplied with a plurality of differently coded O-Rings so that the coding on a particular connector can be changed if the component to which it is connected is changed.

It is understood that several variations may be made in the foregoing without departing from the scope of the invention. For example, the particular coding scheme can vary and the number of rings can vary depending on the particular coding scheme involved. Also, the particular type of connecter is not limited to the RCA connector described above, but could include other connectors known in the audio and video connector art such as balanced (XLR) connectors, and the like. Further the rings can be coded in manners other than by color. For example, other identifying indicia, such as numbers, letters or the like can be provided on the rings to provide the coding discussed above.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. In a home entertainment system having a plurality of different components each of which contributes to the reproduction of audio or video and each of which has a particular color associated therewith, a cable assembly for electrically connecting two of said components, said cable assembly comprising an electrical signal-transmitting cable, a first connector electrically and mechanically connected to one end of said cable for connection to one of said components, a second connector electrically and mechanically connected to the other end of said cable for connection to another of said components to electrically connect said components, an indicia member extending over said first connector and having a color corresponding to the color of said one component, and an indicia member extending over said second connector and having a color corresponding to the color of said other component to insure that said cable assembly is compatible with said one component and said other component.

2. The assembly of claim 1 wherein said indicia members are elastic rings which are quick-detachably inserted over the outer surfaces of the respective connectors.

3. The assembly of claim 2 wherein a plurality of grooves are formed on the outer surface of said connectors for respectively receiving said rings.

4. The assembly of claim 1 wherein each of said connectors comprises a housing for receiving said cable and a pin projecting from said housing and adapted to engage a corresponding jack provided on its corresponding component.

5. The assembly of claim 1 further comprising an additional indicia member associated with each of said connectors, the color of each of said additional indicia members corresponding to a channel of audio information.

6. A cable assembly in a home entertainment system having a plurality of different components each of which contributes to the reproduction of audio or video and each of which has a particular color associated therewith, said cable assembly comprising an electrical signal-transmitting cable, a first connector electrically and mechanically connected to one end of said cable for connection to one of said components, a second connector electrically and mechanically connected to the other end of said cable for connection to another of said components to electrically connect said components, an indicia member extending over said first connector and having a color corresponding to the color of said one component, and an indicia member extending over said second connector and having a color corresponding to the color of said other component to insure that said cable assembly is compatible with said one component and said other component.

7. The assembly of claim 6 wherein said indicia members are elastic rings which are quick-detachably inserted over the outer surfaces of the respective connectors.

8. The assembly of claim 7 wherein a plurality of grooves are formed on the outer surfaces of said connectors for respectively receiving said rings.

9. The assembly of claim 6 wherein each of said connectors comprises a housing for receiving said cable and a pin projecting from said housing and adapted to engage a corresponding jack provided on its corresponding component.

10. The assembly of claim 6 further comprising an additional indicia member associated with each of said connectors, the color of each of said additional indicia members corresponding to a channel of audio information.

* * * * *

UNITED STATES PATENT AND TRADEMARK OFFICE

CERTIFICATE OF CORRECTION

PATENT NO. : 5,529,513

DATED : June 25, 1996

INVENTOR(S) : Noel Lee

It is certified that error appears in the above-indentified patent and that said Letters Patent is hereby corrected as shown below:

Column 2, line 55, change "ting" to --ring--.

Signed and Sealed this

Twenty-fourth Day of September, 1996

*Attest:*

Bruce Lehman

BRUCE LEHMAN

*Attesting Officer*

*Commissioner of Patents and Trademarks*